United States Patent [19]

Golden

[11] 4,411,112

[45] Oct. 25, 1983

[54] SEALING STRIP FOR AN EXPANSION VOID

[75] Inventor: Neil S. Golden, Los Angeles, Calif.

[73] Assignee: Albert H. Allen, Beverly Hills, Calif. ; a part interest

[21] Appl. No.: 315,708

[22] Filed: Oct. 27, 1981

[51] Int. Cl.[3] ..... E04B 7/00

[52] U.S. Cl. ..... 52/288; 52/403; 52/573; 404/65

[58] Field of Search ..... 52/288, 287, 397, 403, 52/573, 396, 776; 404/64, 65, 66, 69

[56] References Cited

U.S. PATENT DOCUMENTS

| | | | |
|---|---|---|---|
| 1,722,660 | 7/1929 | Connelly | 52/288 |
| 2,230,688 | 2/1941 | Irwin | 404/65 |
| 2,716,260 | 8/1955 | Harper | 52/288 |
| 3,155,205 | 11/1964 | Place | 52/397 |
| 3,501,884 | 3/1970 | Di Cesare | 52/397 |
| 4,055,923 | 11/1977 | Biebayck | 52/397 |

FOREIGN PATENT DOCUMENTS

| | | | |
|---|---|---|---|
| 641869 | 4/1964 | Belgium | 52/287 |
| 888004 | 8/1953 | Fed. Rep. of Germany | 52/287 |
| 2546101 | 5/1977 | Fed. Rep. of Germany | 52/403 |
| 1279333 | 11/1961 | France | 52/288 |
| 623104 | 12/1978 | Switzerland | 52/403 |
| 17164 | of 1914 | United Kingdom | 404/64 |

*Primary Examiner*—Henry E. Raduazo
*Attorney, Agent, or Firm*—Sellers and Brace

[57] ABSTRACT

A resilient strip is provided for self-sealing, self-stabilizing installation in a floor expansion void between a room wall and the edge of the floor. The main body of the extruded resilient strip is generally triangular in cross section with a recessed base adapted to engage the wall side of the expansion void and a truncated apex adapted to seat against the floor side of the expansion void adjacent its upper edge thereby placing the upper and lower sides of the strip in compression transversely thereof. The upper side of the strip preferably includes an integral baseboard flange tapering to a thin wall-hugging edge. No fasteners or adhesives are required for installation.

8 Claims, 2 Drawing Figures

SEALING STRIP FOR AN EXPANSION VOID

Figure 1:
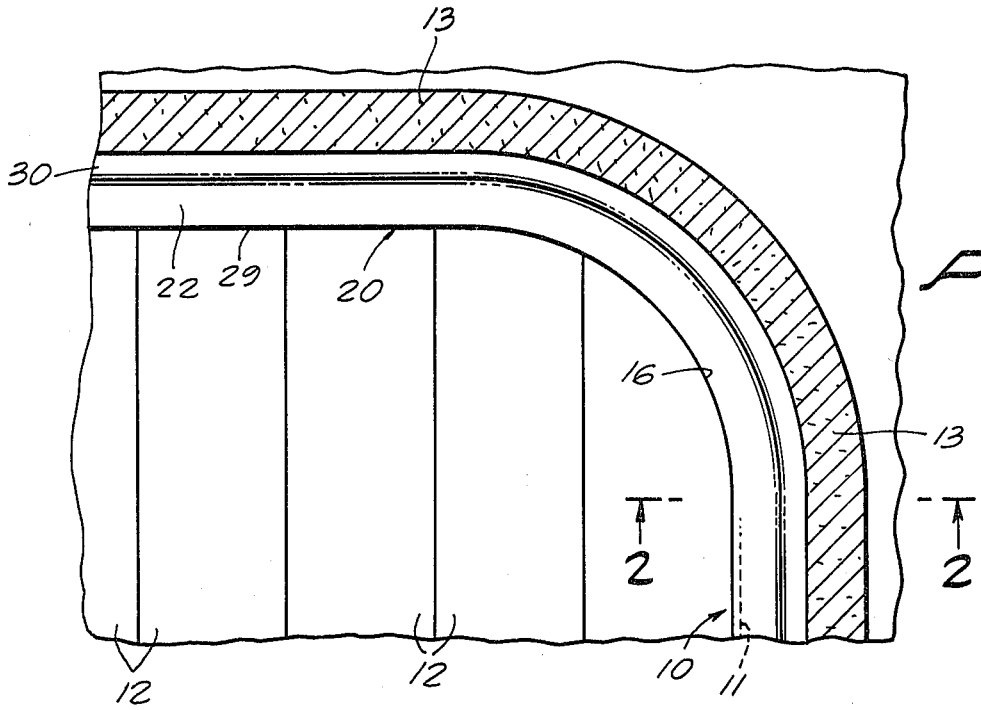

This invention relates to joint seals, and more particularly to a unique resilient strip for self sealing, self stabilizing installation in a floor expansion void or the like gap.

BACKGROUND OF THE INVENTION

There are a wide variety of structural environments having need for a simple highly reliable sealing gasket installable in an expansion joint between adjacent components of a structure. Among these is the expansion void customarily provided between wooden flooring and the adjacent sidewall and sometimes present in tile, marble or terrazo flooring. In the case of hardwood flooring, the sealing expedient must compensate for very substantial expansion and contraction occasioned by varying moisture content. Many proposals have been made heretofore for sealing strips and expedients intended to meet these and other operating requirements. Typical of these are the seals disclosed in the U.S. Patents to Marble U.S. Pat. No. 2,016,968; Irwin U.S. Pat. No. 2,230,688; Tudor-Pole U.S. Pat. No. 3,378,973; Tennison U.S. Pat. No. 3,508,369 and Smith U.S. Pat. No. 3,604,149. Each of these prior teachings is subject to certain disadvantages including the need for bonding or cementitious materials to anchor them in place, or for interlocking engagement with metallic keepers or for reliance upon frictional restraining means. One self-gripping seal design proposes a plurality of relatively long legs flaring outwardly from the opposite sides of the main body of the seal and having wiping contact with the adjacent sidewall of the void being sealed. However, these legs are relatively long, are designed to flex toward one another in the same direction during installation and lack provision for placing the main body in compression transversely of the sealing strip.

SUMMARY OF THE INVENTION

This invention provides a unitary strip of extruded resilient material having numerous novel features avoiding the shortcomings and disadvantages of prior sealing strips. The strip is generally triangular in cross section with its upper and lower surfaces converging toward a truncated apex having one or more ribs engageable with the edge of the floor adjacent the upper edge of the expansion void. The relatively wide base end of the main body is relieved between its upper and lower edges to provide wall engaging ribs spaced at least as far apart as the depth of the expansion void. In consequence of this unique geometry and the fact that the strip, as extruded, is substantially wider than the void to be sealed, the upper and lower converging walls of the strip are placed in compression. The apex portion of the strip is thereby maintained in snug engagement with the floor edge adjacent its top surface and the widely spaced ribs on the opposite side are maintained in firm engagement with the wall side of the void. The upper side of the strip preferably includes a thin sealing lip or flange extending laterally beyond the edge of the void and lying snugly against the top surface of the floor. Additionally an upwardly and outwardly inclined base board flange is positioned to lie in firm sealing contact with the wall in an area substantially above the expansion joint. All portions of the exposed outer surface of the installed sealing strip are gently inclined toward the wall or toward the adjacent flooring for ease of cleaning and drainage. The strip is readily extruded from suitable resilient material such as neoprene or the like, readily compounded in any of a wide range of colors. A durometer of about 60 has been found very satisfactory, but a range of 40 to 80 may be employed to meet a wide variety of specific requirements.

Accordingly it is a primary object of this invention to provide an improved novel sealing strip for expansion voids.

Another object of the invention is the provision of a unitary self-stabilizing sealing strip installable in an expansion void without need for fasteners, bonding agents or other retainer expedients.

Another object of the invention is the provision of an extruded resilient sealing strip for an expansion void of generally triangular configuration and sized to be maintained in compression transversely thereof upon installation.

Another object of the invention is the provision of an extruded resilient sealing strip for expansion voids readily manufactured in a wide range of different colors and readily installed without fasteners in both straight and curvilinear portions of an expansion void.

These and other more specific objects will appear upon reading the following specification and claims and upon considering in connection therewith the attached drawing to which they relate.

Figure 2:
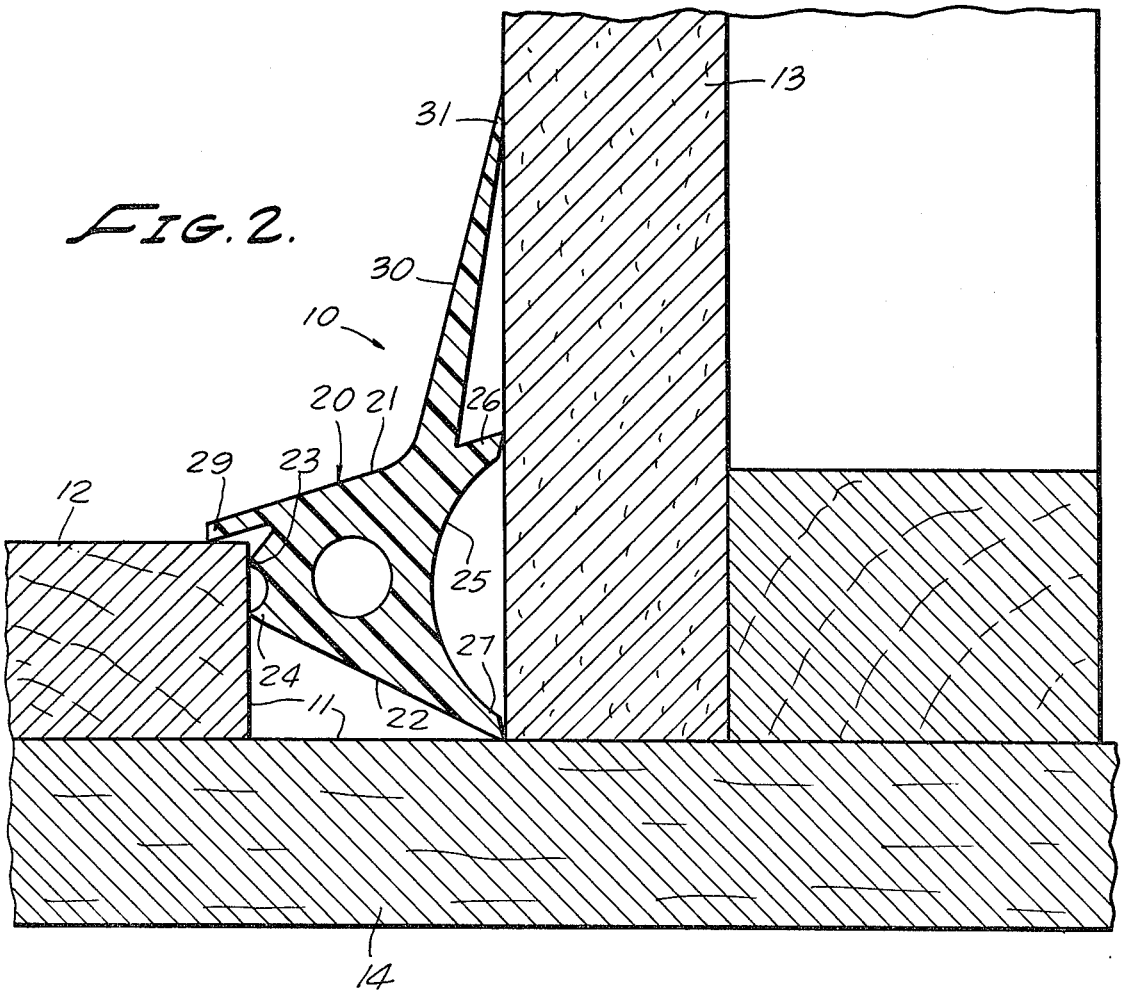

Referring now to the drawing in which a preferred embodiment of the invention is illustrated:

FIG. 1 is a horizontal cross sectional view through one corner of a room showing the invention sealing strip installed in an expansion groove between the flooring and the sidewall; and FIG. 2 is a cross sectional view on an enlarged scale taken along line 2—2 on FIG. 1.

Referring to FIGS. 1 and 2, there is shown an illustrative embodiment of the invention sealing strip, designated generally 10, installed in an expansion void 11 between the perimeter edge of flooring 12 and the room wall 13. As herein shown, flooring 12 comprises strips of hardwood secured in customary manner to a subfloor 14. However, it will be understood that floor 12 may comprise tile, marble, terrazo or any of many other different types of masonary and non-masonary flooring. As herein shown, expansion void 11 includes a curvilinear section 16 merging with straight sections filled with a continuous length of sealing strip 10.

Sealing strip 10 has a generally triangular main body 20 the upper and lower surfaces 21, 22 of which converge toward a truncated apex having a pair of closely spaced parallel ribs 23, 24. The wider base end of the main body is provided with a generally convex recess 25 cooperating with the upper and lower edges of which are flush with inner surfaces of a pair of flexible wall contacting ribs 26 and 27. Each of the ribs 23, 24, 26 and 27 preferably terminates in a sharp edge engageable with an adjacent sidewall portion of void 11. Ribs 23 and 24 are spaced relatively close together and seat against the floor side of void 11 closely adjacent its upper corner as shown in FIG. 2. In contrast, ribs 26 and 27 are relatively far apart with rib 26 positioned to engage wall 13 at a level near or above the top surface of flooring 12 and rib 27 positioned to engage wall 13 at the lower outer corner of void 11, that is at the junction of wall 13 with sub-floor 14.

The upper side of the main body 20 includes a thin flexible lip 29 extending over the peripheral edge of void 11 and lying in firm sealing contact with the top surface of flooring 12 and serving additionally as a stop to limit the insertion of the apex side of the main body into void 11.

As herein shown, the main body is also provided with an upwardly and outwardly flaring baseboard flange 30 with its feather thin upper edge 31 positioned to rest firmly against the wall 13. For some installations flange 30 is not required and may be omitted.

As originally molded and before installation, the main body 20 of the strip has a relaxed width between the tips of ribs 24 and the tips of ribs 26 and 27 very substantially exceeding the width of void 11. Also the distance between the tips of ribs 26 and 27 is substantially less than when installed.

When laying the flooring 12, a spacer strip having a thickness corresponding to the horizontal width of void 11 is placed against the wall. Flooring 12 whether of wood, tile, or marble, or other material is then laid flush against the spacer strip thereby providing assurance that void 11 will be of predetermined uniform width after the flooring is laid and the spacer strip is removed. Thereafter the strip is installed simply by pressing it progressively into void 11 until lip 29 is in contact with the top surface of the floor.

During the installation all ribs are slightly deformed. Thus ribs 23 and 24 are placed in compression transversely of void whereas ribs 26 tend to spread away from one another as they are placed in compression along areas with a respective one of the ribs 23 and 24. In other words the upper portion of the main body 20 is in compression generally parallel to upper surface 21 and the lower portion of the main body is in compression generally parallel to lower surface 22. As will be recognized, these upper and lower areas in compression diverge from one another toward the wall thereby tending to spread ribs 26 and 27 vertically apart and very substantially augmenting the stabilization of the strip in its installed position. These substantial portions of the strip in compression cooperate to stabilize and lock the strip firmly installed in the void. The tapering and converging sidewalls of the four ribs not only assure firm sealing contact with the sidewalls at multiple points but also enhances the ability of the strip as a whole to compensate for contraction and expansion of the structural members forming void 11.

While the particular sealing strip for an expansion void herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A strip for sealing an expansion void between the floor and a room wall comprising:

an elongated extruded strip of resilient material of uniform cross section having upper and lower surfaces converging toward one another from a relatively wide wall-engaging lateral side thereof;

said wall-engaging side of said strip being recessed and provided with upper and lower ribs extending lengthwise thereof, said upper rib being adapted to seat firmly against the wall adjacent the top of said void and said lower rib being adapted to seat firmly against the wall adjacent the bottom of said void;

the opposite relatively narrow lateral side of said strip being provided with at least one rib adapted to seat firmly against the edge of the floor side of said expansion void adjacent but below the upper surface of the floor; and said ribs along the opposite lateral sides of said strip being adapted to cooperate with one another in providing a self-stabilizing generally triangular anchorage effective to lock said strip firmly assembled in said expansion void.

2. A sealing strip as defined in claim 1 characterized in that the relatively narrow floor-engaging lateral side of said strip is provided with a plurality of closely spaced ribs seatable against the edge of the floor adjacent the upper side thereof.

3. A sealing strip as defined in claim 1 characterized in that the floor-engaging lateral side of said strip includes a relatively thin sealing lip along the uppermost edge thereof; said sealing lip projecting laterally outwardly beyond the edge of said floor engaging rib and adapted to lie in sealing contact with the top surface of the floor.

4. A sealing strip as defined in claim 1 characterized in that the durometer of said resilient material ranges between 40 and 80.

5. A sealing strip as defined in claim 1 characterized in that, when installed in an expansion void, the portions of said strip adjacent a respective one of said upper and lower surfaces is under compression in planes inclined in opposite directions relative to a horizontal plane.

6. A sealing strip as defined in claim 1 characterized in that said strip includes a wall-engaging base board flange projecting outwardly from and integral with said upper surface of said strip, said flange having a relatively thin lateral edge remote from said upper surface positioned to lie flush against a room wall when said strip is seated in said expansion void.

7. A sealing strip as defined in claim 6 characterized in that said wall-engaging base board flange is inclined acutely to the wall surface when installed in said expansion void.

8. A sealing strip as defined in claim 1 and 6 characterized in that said strip is sufficiently flexible and resilient for snug sealing installation in a curvilinear portion of an expansion void.

* * * * *